US007661477B2

(12) United States Patent
Sheiretov et al.

(10) Patent No.: US 7,661,477 B2
(45) Date of Patent: Feb. 16, 2010

(54) SYSTEM AND METHOD FOR UNSTICKING A TOOL STUCK IN A WELLBORE

(75) Inventors: Todor K. Sheiretov, Houston, TX (US); Matthew Billingham, Houston, TX (US); Wayne Fulin, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 63 days.

(21) Appl. No.: 11/278,294

(22) Filed: Mar. 31, 2006

(65) Prior Publication Data

US 2007/0227736 A1 Oct. 4, 2007

(51) Int. Cl.
*E21B 31/107* (2006.01)

(52) U.S. Cl. ..... 166/301; 166/178; 166/98

(58) Field of Classification Search ..... 166/301, 166/98, 99, 178
See application file for complete search history.

(56) References Cited

U.S. PATENT DOCUMENTS

| | | | | |
|---|---|---|---|---|
| 5,033,549 | A | 7/1991 | Champeaux | |
| 5,115,860 | A | 5/1992 | Champeaux | |
| 5,224,547 | A | 7/1993 | Burns | |
| 5,228,507 | A | 7/1993 | Obrejanu | |
| 5,310,001 | A | 5/1994 | Burns | |
| 5,322,118 | A | 6/1994 | Terrell | |
| 5,398,753 | A | 3/1995 | Obrejanu | |
| 5,575,331 | A | 11/1996 | Terrell | |
| 5,592,991 | A | 1/1997 | Lembcke | |
| 5,636,689 | A | 6/1997 | Rubbo | |
| 5,778,980 | A | 7/1998 | Comeau | |
| 6,029,744 | A | 2/2000 | Baird | |
| 6,179,055 | B1 * | 1/2001 | Sallwasser et al. | 166/254.2 |
| 6,196,309 | B1 | 3/2001 | Estilette | |
| 6,868,901 | B2 | 3/2005 | Mason | |
| 2002/0112859 | A1 * | 8/2002 | Bloom et al. | 166/381 |
| 2005/0056427 | A1 * | 3/2005 | Clemens et al. | 166/301 |
| 2007/0151732 | A1 * | 7/2007 | Clemens et al. | 166/301 |

* cited by examiner

*Primary Examiner*—David J Bagnell
*Assistant Examiner*—Brad Harcourt
(74) *Attorney, Agent, or Firm*—Rodney Warfford; Dave Cate; Jaime Castano

(57) ABSTRACT

An unsticking assembly for releasing a tool that is stuck in a wellbore including a first anchor actuatable between an engaging position wherein the first anchor engages a wall of the wellbore and a retracted position wherein the first anchor does not engage the wall; a second anchor actuatable between an engaging position wherein the second anchor engages a wall of the wellbore and a retracted position wherein the second anchor does not engage the wall; and a control module in connection with the first and second anchor to selectively actuate each anchor between the engaged and retracted positions. The assembly is adapted for positioning in the wellbore and in connection with the tool when the tool is stuck in the wellbore. The assembly may be a stand-alone assembly that is connectable to the tool after the tool is stuck in the wellbore. The assembly may include the wellbore tool as an interconnected element.

19 Claims, 2 Drawing Sheets

SYSTEM AND METHOD FOR UNSTICKING A TOOL STUCK IN A WELLBORE

FIELD OF THE INVENTION

The present invention relates in general to wellbore operations and more specifically to a method and apparatus for unsticking a wellbore tool that is stuck in a wellbore.

BACKGROUND

During wireline logging operations, the logging tool can become stuck in the wellbore due to differential pressure between the hydrostatic and formation pressure, as a result of a component on the tool being mechanically stuck to the wellbore, or due to a collapse of the wellbore around the tool. Typical fishing operations are conducted by a rig on drillpipe in open holes or on a slickline or drillpipe in cased holes. These fishing operations are time consuming and expensive.

Therefore, it is a desire to provide an unsticking system and assembly that can release a tool stuck in a wellbore addressing drawbacks of prior art fishing operations. It is a still further desire to provide an unsticking system that may include a stand-alone assembly that is connected to the stuck tool after the tool is stuck. It is a still further desire to provide an unsticking system that may include the tool in the unsticking tool for conducting operations substantially simultaneous with the tool sticking.

SUMMARY OF THE INVENTION

Accordingly, a system, device and method are provided for unsticking a tool that is stuck in a wellbore. An embodiment of a method for unsticking a tool that is stuck in a wellbore comprises the steps of providing an unsticking assembly in connection with a tool that is stuck in a wellbore, the system including a first and a second anchor; selectively actuating the anchors to engage a wall of the wellbore; and disengaging the anchors from the wall. The wellbore tool may be connected within and be a part of the unsticking system. The unsticking assembly may be a stand-alone assembly that is connectable to the wellbore tool after the tool is stuck in the wellbore.

Another method for unsticking a tool that is stuck in a wellbore includes the steps of providing an unsticking assembly in connection with a tool that is stuck in a wellbore, the unsticking assembly including a first and a second anchor and a linear actuator; engaging the first anchor with a wall of the wellbore; operating the linear actuator to urge the tool relative to the first anchor; disengaging the first anchor from engagement with the wall; engaging the second anchor with the wall, if the tool is not released from its stuck position; operating the linear actuator to move the first anchor relative to the second anchor; disengaging the second anchor from the wall; and repeating the steps of engaging the first anchor, operating the linear actuator, disengaging the first anchor, engaging the second anchor, operating the linear actuator and disengaging the second anchor until the tool is released from the stuck position.

An embodiment of an unsticking assembly for releasing a tool that is stuck in a wellbore including a first anchor actuatable between an engaging position wherein the first anchor engages a wall of the wellbore and a retracted position wherein the first anchor does not engage the wall; a second anchor actuatable between an engaging position wherein the second anchor engages a wall of the wellbore and a retracted position wherein the second anchor does not engage the wall; and a control module in connection with the first and second anchor to selectively actuate each anchor between the engaged and retracted positions. The assembly is adapted for positioning in the wellbore and in connection with the tool when the tool is stuck in the wellbore. The assembly may be a stand-alone assembly that is connectable to the tool after the tool is stuck in the wellbore. The assembly may include the wellbore tool as an interconnected element.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 2B:
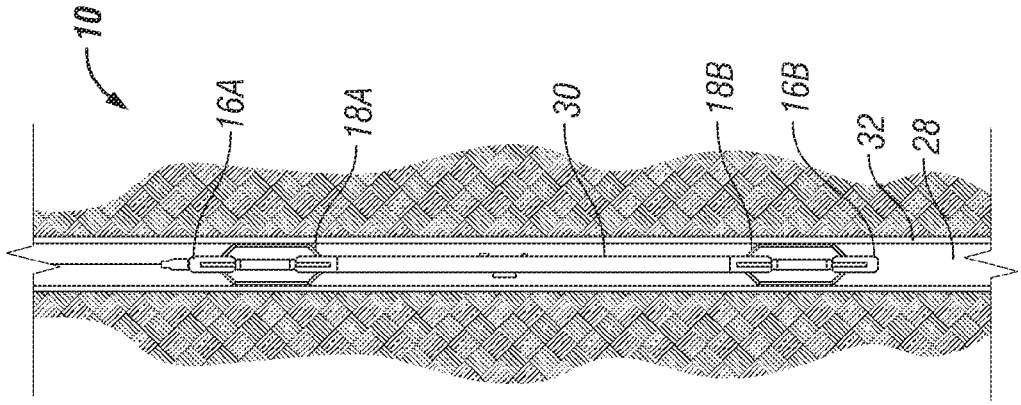
FIG. 2B is an illustration of the operation of the unsticking system of FIG. 2A.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

Figure 2A:
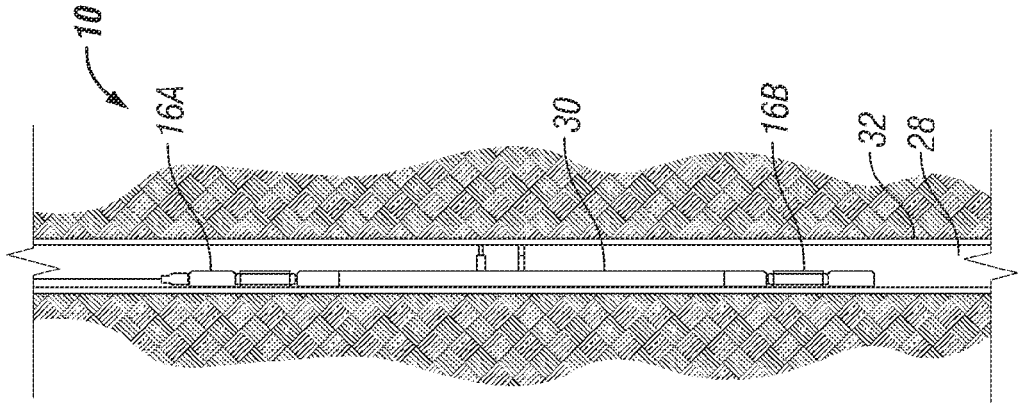
FIG. 2A is an illustration of an embodiment of an unsticking assembly including a logging tool, wherein the logging tool is in a stuck position in a wellbore.
Figure 1:
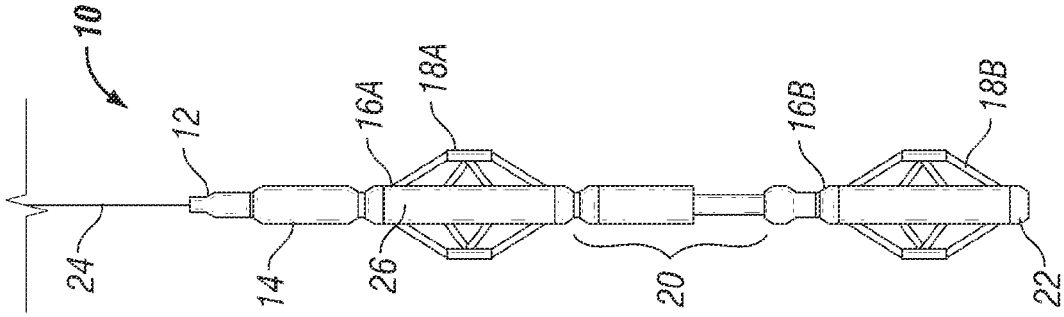
FIG. 1 is a view of an embodiment of an unsticking system of the present invention shown as a stand-alone assembly.

FIG. 1 is a view of an embodiment of an unsticking system of the present invention, generally denoted by the numeral 10, shown as a stand-alone assembly. System 10 includes a head 12, a control module 14, and a first and a second anchor 16*a*, 16*b* respectively. Each anchor assembly 16 has extendable arms 18. System 10 may further include a linear actuator 20 and a fishing connection 22, referred to herein as an overshot. Unsticking system 10 may be used as a stand-alone assembly connectable to a tool via fishing connection 22 (FIGS. 1 and 3A-3F). Unsticking system 10 may run as an assembly including a wellbore tool 30 connected between the first and second anchors 16*a*, 16*b* (FIGS. 2A and 2B).

In the present embodiment, head 12 is a standard wireline logging head providing electrical and mechanical connection to the surface via wireline 24. Control module 14 includes motor controls, motor drive electronics and may further include a hydraulic pump and its associated hydraulic controls. Control module 14 is in functional connection with anchors 16 and linear actuator 20 and positioned within the wellbore during operation. Inclusion of the driving mechanisms in assembly 10 facilitates running the assembly in the well via a wireline.

Anchor 16 includes a housing 26 and arms 18. Arms 18 are hydraulically actuated and may be actuated to extend outward from housing 26 or be retracted to, or within housing 26, via signals sent to control module 14 from the surface via line 24. First anchor 16*a* and second anchor 16*b* may be actuated independently, such that when arms 18*a* are extended, arms 18*b* are retracted and vice versa or simultaneously. Although communication with control module 14 is described herein via line 24, it is understood that other mechanism for communication, such as, but not limited to wireless telemetry may be utilized.

Linear actuator 20 provides axial movement of first anchor 16*a* and second anchor 16*b* relative to one another along the longitudinal axis of assembly 10. For example, linear actuator 20 may be operated to move first anchor 16*a* and second anchor 16*b* closer together or farther apart. In the illustrated embodiment, linear actuator 20 is hydraulic so as to provide sufficient force to act on anchors 16 or the wellbore tool within the wellbore.

Referring to FIGS. 2A and 2B, unsticking system 10, shown as an assembly incorporating well tool 30, is in operation in a wellbore 28. Tool 30 is illustrated as a formation sampling tool, however, it should be recognized that tool 30 may be any type of wellbore tool including drillpipe. First anchor 16*a* is connected above tool 30 and second anchor 16*b* is connected within system 10 below tool 30. Although not shown in the illustrated embodiment, linear actuator 20 (FIG. 1) may be connected within assembly 10 between first and second anchors 16*a* and 16*b* and in connection with tool 30. Linear actuator 20 may further be utilized to apply a pulling or pushing force on tool 30.

As is well known in wellbore operations, tools often become stuck in the wellbore due to differential sticking caused by the differential pressure between the hydrostatic pressure and formation pressure, the tool being mechanically stuck to wellbore wall 32, and due to debris around the tool. In FIG. 2A, tool 30 and thus assembly 10 is stuck to wellbore wall 32.

FIG. 2B illustrates a method of operating system 10 to release tool 30 from wall 32. Anchors 16*a* and 16*b* are actuated such that arms 18*a* and 18*b* extend outward and engage or contact wall 32. Anchors 16 when actuated to the extended position, tend to centralize tool 30 in wellbore 28, facilitating the release of tool 30 from the stuck position. Although not illustrated in FIGS. 2A and 2B, a linear actuator 20 (FIGS. 1, 3A-3F) may be included within assembly 10. The inclusion of a linear actuator provides the ability to apply a further axial pulling or pushing force on tool 30 to aide in unsticking it. Once tool 30 is unstuck, anchors 16 are actuated to the retracted position wherein arms 18 are disengaged from wall 32. Assembly 10 may then be removed from wellbore 28 or wellbore operations may be continued.

Figure 3F:
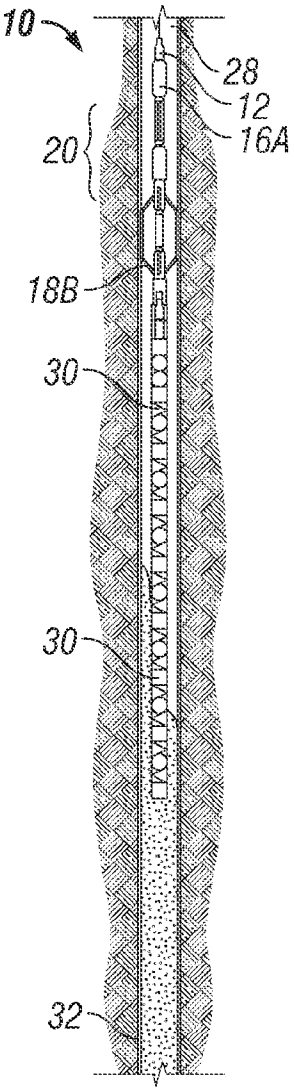
FIG. 3A-3F illustrate an embodiment of a method of releasing a wellbore tool from a stuck position in a wellbore.
Figure 3E:
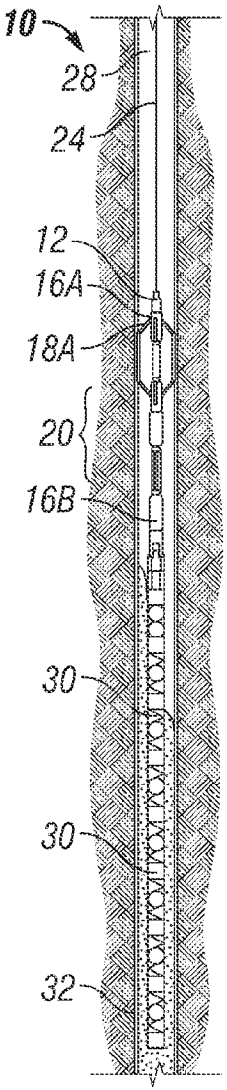
Figure 3D:
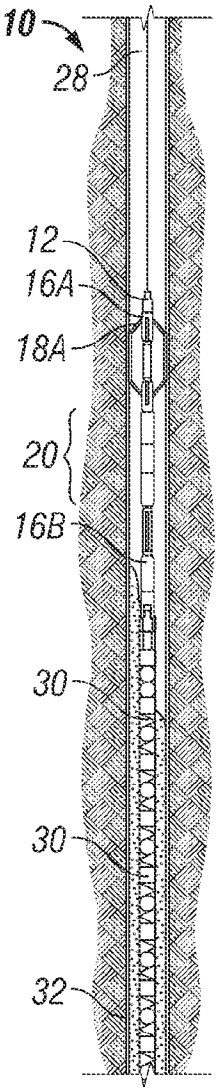
Figure 3C:
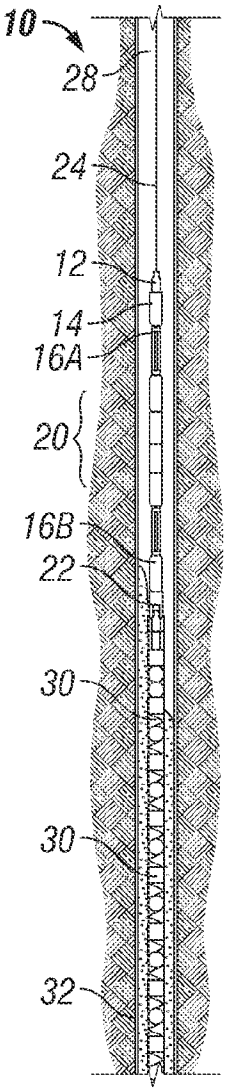
Figure 3B:
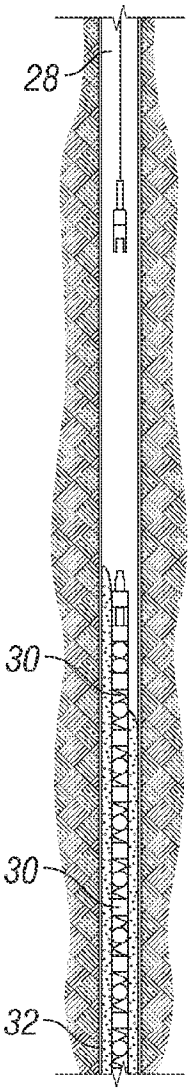
Figure 3A:
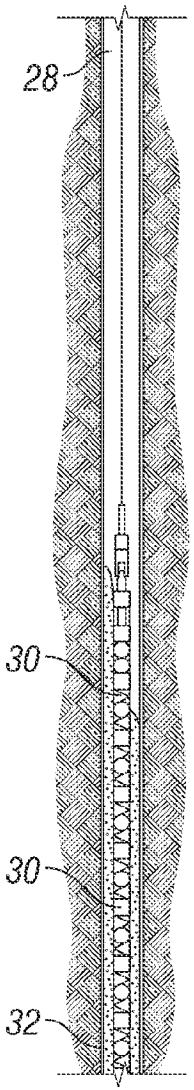

FIGS. 3A through 3F illustrate an embodiment of a step by step method of unsticking a wellbore tool 30 that is stuck in wellbore 28. In this embodiment, the unsticking system is shown as a stand-alone assembly 10 adapted for connecting to tool 30 after it is stuck in the wellbore. It should be readily recognized that the method described in relation to FIGS. 3A and 3F is applicable to various unsticking assemblies of the present invention, including an assembly including a tool 30 connected between first anchor 16*a* and second anchor 16*b*.

In FIG. 3A, wellbore tool 30 is stuck in wellbore 28 by debris. In FIG. 3B, the wireline is disconnected from tool 30 and pulled to the surface. Assembly 10 including an overshot 22 is run into wellbore 28 and connected to the fishing neck of tool 30 via overshot 22. First anchor 16*a* is actuated so as to engage wall 32 of wellbore 28 (FIG. 3D). In the illustrated embodiments, first anchor 16*a* engages wall 32 via arms 18*a*, however, it should be recognized that anchors 16 may include bladders or other elements for contacting and engaging wall 32. With first anchor 16*a* engaging wall 32, linear actuator 20 is operated, urging tool 30 and second anchor 18*a* toward first anchor 16*b*. Linear actuator 20 may be operated back and forth in a reciprocating motion to free tool 30 for movement (FIG. 3E). First anchor 16*a* is then disengaged from wall 32 (FIG. 3F). If tool 30 is unstuck at this point, it may be removed from wellbore 30. If tool 30 is still stuck, second anchor 16*b* is engaged and liner actuator 20 is operated to move first anchor 16*a* away from second anchor 16*b* and further up wellbore 28. The steps beginning at engaging wall 32 with first anchor 16*a* (FIG. 3D) are then repeated until tool 30 is released from the stuck position.

From the foregoing detailed description of specific embodiments of the invention, it should be apparent that a system and method for releasing a tool from a stuck position within a wellbore that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method for unsticking a tool that is stuck in a wellbore, the method comprising the steps of:

providing an unsticking assembly in connection with a tool that is stuck in a wellbore, the assembly including a first and a second anchor;

connecting the unsticking assembly to the tool after the tool is stuck in the wellbore;

independently actuating the anchors to engage a wall of the wellbore; and disengaging the anchors from the wall.

2. The method of claim 1, wherein the first anchor and the second anchor are actuated substantially simultaneously to engage the wall and urge the tool away from the wall.

3. The method of claim 2, wherein the first anchor is connected above the tool and the second anchor is connected below the tool.

4. The method of claim 1, wherein the first anchor is connected above the tool and the second anchor is connected below the tool.

5. The method of claim 1, wherein the first anchor and the second anchor are alternately actuated to engage the wall.

6. The method of claim 1 wherein the unsticking assembly comprises a linear actuator and wherein the method further comprises:

engaging the first anchor with the wall of the wellbore;

operating the linear actuator to urge the tool relative to the first anchor;

disengaging the first anchor from engagement with the wall;

engaging the second anchor with the wall, if the tool is not released from its stuck position;

operating the linear actuator to move the first anchor relative to the second anchor;

disengaging the second anchor from the wall; and repeating the steps of engaging the first anchor, operating the linear actuator, disengaging the first anchor, engaging the second anchor, operating the linear actuator and disengaging the second anchor until the tool is released from the stuck position.

7. The method of, claim 6, wherein the unsticking assembly comprises a stand-alone assembly adapted for connecting to the tool after the tool is stuck in the wellbore.

8. The method of claim 7, wherein the linear actuator is connected between the first anchor and the second anchor.

9. The method of claim 7, wherein the unsticking assembly further includes a control module in connection with the first anchor, the second anchor and the linear actuator, the control module adapted to be positioned within the wellbore.

10. The method of claim 6, wherein the tool is connected between the first anchor and the second anchor.

11. The method of claim 10, wherein the unsticking assembly further includes a control module in connection with the first anchor, the second anchor and the linear actuator, the control module adapted to be positioned within the wellbore.

12. The method of claim 6, wherein the linear actuator is connected between the first anchor and the second anchor.

13. The method of claim 6, wherein the unsticking assembly further includes a control module in connection with the first anchor, the second anchor and the linear actuator, the control module adapted to be positioned within the wellbore.

14. The method of claim 1, wherein the first anchor is actuatable between an engaging position wherein the first anchor engages the wall of the wellbore and a retracted position wherein the first anchor does not engage the wall;

the second anchor is actuatable between an engaging position wherein the second anchor engages the wall of the wellbore and a retracted position wherein the second anchor does not engage the wall; and a control module in connection with the first and second anchor to independently actuate each anchor between the engaged and retracted positions;

wherein the assembly is adapted for positioning in the wellbore and in connection with the tool when the tool is stuck in the wellbore.

15. The assembly of claim 14, further including the tool being connected between the first and the second anchor.

16. The assembly of claim 15, further including a linear actuator connected between the first and second anchors.

17. The assembly of claim 14, wherein the assembly is constructed as a stand-alone assembly further including a fishing connection adapted to connect the assembly to the tool when it is stuck in the wellbore.

18. The assembly of claim 17, further including a linear actuator connected between the first and second anchors.

19. The assembly of claim 14, further including a linear actuator connected between the first and second anchors.

* * * * *

UNITED STATES PATENT AND TRADEMARK OFFICE

CERTIFICATE OF CORRECTION

PATENT NO. : 7,661,477 B2
APPLICATION NO. : 11/278294
DATED : February 16, 2010
INVENTOR(S) : Sheiretov et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 111 days.

Signed and Sealed this

Thirtieth Day of November, 2010

David J. Kappos

David J. Kappos
*Director of the United States Patent and Trademark Office*